United States Patent [19]

Brandt

[11] Patent Number: 4,896,459

[45] Date of Patent: Jan. 30, 1990

[54] APPARATUS FOR MANUFACTURING THIN WAFERS OF HARD, NON-METALLIC MATERIAL SUCH AS FOR USE AS SEMICONDUCTOR SUBSTRATES

[75] Inventor: Georg Brandt, Erlangen, Fed. Rep. of Germany

[73] Assignee: GMN Georg Muller Nurnberg A.G., Fed. Rep. of Germany

[21] Appl. No.: 191,682

[22] Filed: May 9, 1988

Related U.S. Application Data

[63] Continuation-in-part of Ser. No. 39,666, Apr. 16, 1987, abandoned, which is a continuation-in-part of Ser. No. 112,541, Oct. 26, 1987, abandoned.

[30] Foreign Application Priority Data

Apr. 18, 1986 [DE] Fed. Rep. of Germany ..... 3613132

[51] Int. Cl.[4] ..... B24B 7/00

[52] U.S. Cl. ..... 51/5 C; 51/73 R; 51/118; 51/283 R; 125/13 R

[58] Field of Search ..... 29/558; 51/5 C, 73 R, 51/118, 283 R; 125/13 R

[56] References Cited

U.S. PATENT DOCUMENTS

| | | | |
|---|---|---|---|
| 2,382,257 | 8/1945 | Ramsay | 125/13 R X |
| 3,154,990 | 11/1964 | Woods | 125/13 R X |
| 3,828,758 | 8/1974 | Cary | 125/13 R |
| 4,633,847 | 1/1987 | Lossp et al. | 125/13 R |
| 4,712,535 | 12/1987 | Fujisawa | 51/73 R X |

*Primary Examiner*—Mark Rosenbaum
*Assistant Examiner*—Frances Chin
*Attorney, Agent, or Firm*—Steinberg & Raskin

[57] ABSTRACT

Method and apparatus for manufacturing thin wafers of hard, non-metallic material, such as monocrystalline or polycrystalline material for use as semiconductor substrates from bars of such material include an arrangement wherein prior to the completion of a slicing step wherein a disc-shaped workpiece or wafer is sliced from the bar, an end face of the bar is planed to a precisely planar condition whereupon the bar is sliced to separate a disc-shaped workpiece or wafer therefrom having a planar reference surface constituted by the planed end face of the bar. The apparatus can include an internal hole saw for slicing the bar and a grinding device for planing the end face thereof.

7 Claims, 7 Drawing Sheets

FIG. 8(a)
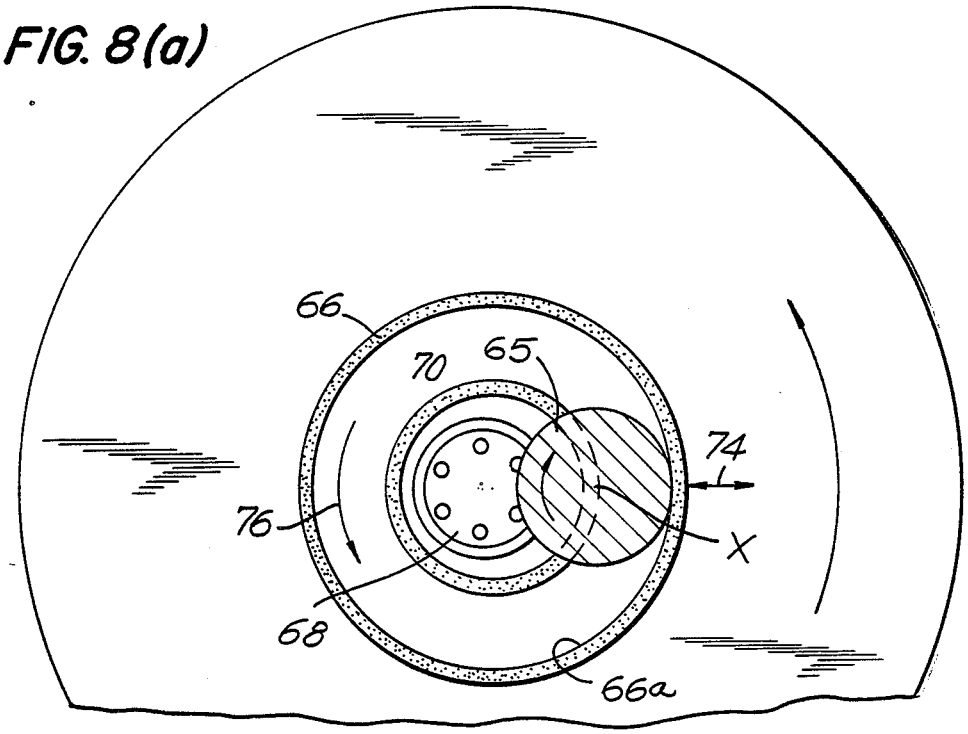
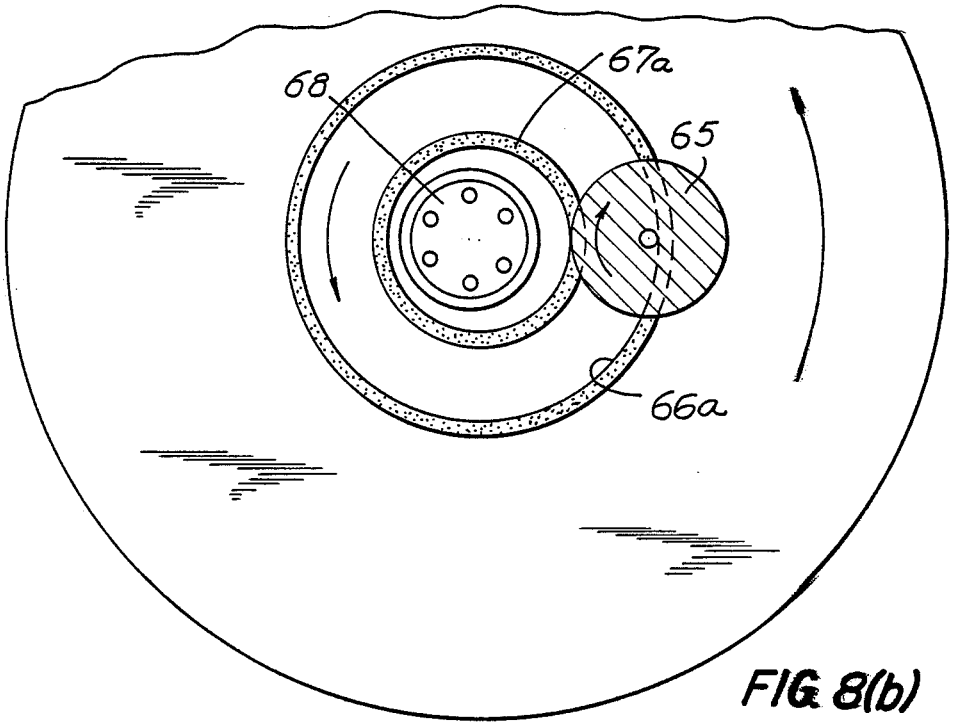
FIG. 8(b)

APPARATUS FOR MANUFACTURING THIN WAFERS OF HARD, NON-METALLIC MATERIAL SUCH AS FOR USE AS SEMICONDUCTOR SUBSTRATES

BACKGROUND OF THE INVENTION

This application is a continuation-in-part of application Ser. No. 039,666 filed Apr. 16, 1987 now abandoned and a continuation-in-part of application Ser. No. 112,541, filed Oct. 26, 1987, now abandoned.

This invention relates generally to methods and apparatus for manufacturing thin wafers of hard, non-metallic material and, more particularly, to methods and apparatus for manufacturing thin wafers of hard, non-metallic materials having at least one planar surface, such as are used as semiconductor substrates.

The production of extremely thin wafers or rounds of hard, non-metallic material is required in certain applications. For example, substrates for electronic components are formed from non-metallic, monocrystalline or polycrystalline materials, such as silicon or germanium arsenide, which are quite brittle and which have a Vickers hardness of up to about HV 15000 N/mm$^2$. The physical characteristics of the material place heavy demands on machining processes.

Wafers for semiconductor substrates are conventionally manufactured by first producing a cylindrical bar of the substrate material. The bar is then sliced transversely to its longitudinal axis, usually using internal hole saws, to obtain discs whose surfaces are then ground to obtain the semiconductor wafers. However, a serious problem exists in such techniques in that it is extremely difficult to produce wafers with at least one precisely planar surface and even more difficult to produce wafers whose opposed sides are precisely planar and parallel to each other.

More particularly, the cutting or slicing tool tends to migrate or deviate from its intended path during conventional slicing operations under the influence of the various forces which act on the tool during the processing and due to wear and tear on the tool.

Such migration results in a non-uniformity in the geometry of the disc and, in particular, the surfaces of the disc produced are neither planar nor parallel to each other. Rather, the surfaces of the disc are non-uniform and, as seen below, subsequent planing operations cannot produce a wafer having planar and parallel surfaces.

A wafer manufactured according to the conventional technique is illustrated in FIG. 1 (in exaggerated form) to which reference is now made and from which it is seen that even further processing steps cannot correct "out-of-plane" error in the conventionally produced disc or workpiece. The surfaces 10 and 11 of a disc or workpiece 12 manufactured by slicing from a cylindrical bar in accordance with conventional techniques are slightly bowed as seen in FIG. 1(*a*) due to the deviation of the cutting or slicing tool, the extent of the bowing being on the order of a few microns ( ). When the thin workpiece 12 is clamped by suction onto a planar clamping plate 13 for further processing, the surface 11 engaging the clamping plate 13 becomes planar (FIG. 1(*b*)) due to the slight elasticity of the workpiece material. This elastic deformation, however, sets up a prestress in the clamped workpiece. The free surface 10 is then machined by any conventional planing process to a planar surface 10' (FIG. 1(*c*)) to produce the wafer 14. However, when the wafer 14 is released from clamping plate 13, the surface 11 of the wafer facing the clamping plate 13 assumes its original form as seen in FIG. 1(*d*) under the effect of the pre-stresses set up in the workpiece when it is initially clamped to the plate and since the wafer is extremely thin. This bowing of the surface cannot be corrected in subsequent processing steps. Moreover, even if the wafer 14 is then turned over, clamped to plate 13 with surface 10' being flexed into planar condition, and surface 11 then planed, a bowing would still exist when the wafer is released. It is seen from the foregoing that although it is possible to obtain a wafer having parallel surfaces, e.g. surfaces 10' and 11 are parallel to each other, it is not possible to obtain precisely planar surfaces according to conventional techniques.

SUMMARY OF THE INVENTION

Accordingly, it is an object of the present invention to provide new and improved methods and apparatus for manufacturing wafers of hard, non-metallic material having at least one precisely planar surface.

It is another object of the present invention to provide new and improved methods and apparatus for manufacturing wafers of hard, non-metallic material having opposite surfaces which are planar and parallel to each other.

Briefly, in accordance with the present invention, these and other objects are attained by providing a method wherein the slicing process by which the workpiece is cut or sliced and separated from the bar and the planing process by which a non-planar surface of the workpiece is machined to planar condition are essentially integrated. In particular, in accordance with the method of the invention, the uneven end face of the bar is planed, such as by a grinding process, to a precisely planar condition. The workpiece or wafer is then formed by slicing the bar at the end of the planed end face in the conventional manner, such as by using an internal hole saw. The resulting disc or workpiece thus has an uneven surface (the surface obtained by slicing) and a precisely planar reference surface (the previously planed bar surface). However, since the sliced workpiece has one precisely planar surface, it can be clamped onto a planar clamping plate without any elastic distortion. Thus, workpiece is then clamped to a planar clamping plate with its planar reference surface engaging the plate whereupon the opposite surface is then machined to a planar condition parallel to the already plane surface engaging the clamping plate to produce the wafer. When the wafer is released from the clamping plate, it no longer elastically deforms since there are no pre-stresses set up in the workpiece when it is initially clamped to the plate. The process is repeated, i.e. the newly formed end surface of the bar is then planed, etc. in the manufacture of additional wafers.

Apparatus in accordance with the invention includes in its simplest form a combination of bar slicing means, e.g., an internal hole saw, and surface planing means, e.g., a grinding machine. In one embodiment, the surface planing means act through the opening of the internal hole saw after the previously formed workpiece has been sliced. In other embodiments, the surface planing means acts through the opening of the internal hole saw at the same time as the workpiece is being sliced from the bar. In still other embodiments, the planing and slicing means are spaced from each other and means are provided for transferring the bar after its end face has been planed by the planing means to the slicing means where the workpiece is then sliced from the bar.

DESCRIPTION OF THE DRAWINGS

A more complete appreciation of the present invention and many of the attendant advantages thereof will be readily understood by reference to the following detailed description when considered in connection with the accompanying drawings in which:

FIG. 8A is a schematic plan view of the embodiment of the apparatus of FIG. 7 during operation at a stage at which the bar is about to enter the saw blade, and FIG. 8B is a view similar to FIG. 8A at a stage of operation at which the slicing step is nearly completed.

DESCRIPTION OF THE PREFERRED EMBODIMENTS

Figure 1A:
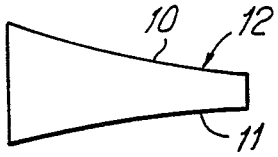
FIG. 1(a) PRIOR ART
FIGS. 1(*a*)–1(*d*) are schematic views illustrating a prior art technique for manufacturing thin material of hard, non-metallic wafers.
Figure 11B:
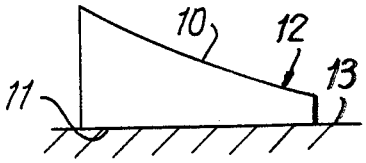
FIG. 11(b) PRIOR ART
Figure 1C:
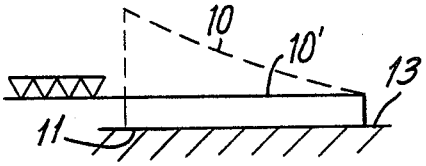
FIG. 1(c) PRIOR ART
Figure 1C:
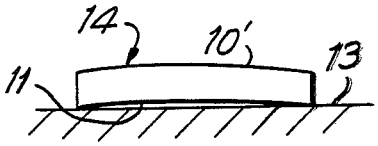
FIG. 1(c) PRIOR ART
Figure 2:
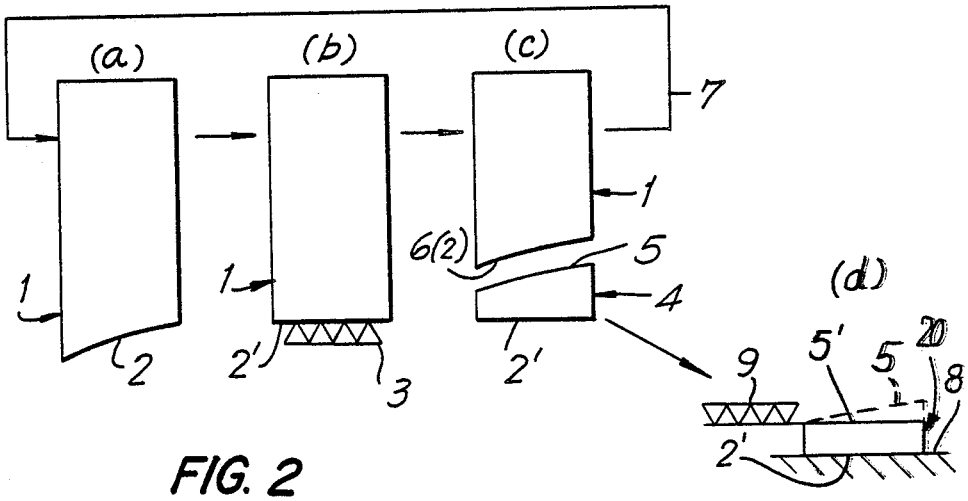
FIG. 2 is schematic view illustrating the steps of a method in accordance with the invention for manufacturing the wafers of hard, non-metallic material.

Referring now to the drawings, and more particularly to FIG. 2, a method in accordance with the invention will be described with specific reference to the manufacture of semiconductor wafers for electronic chip components from a cylindrical bar 1 formed of a hard, non-metallic material, such as silicon or germanium arsenide. At stage (a) of the method the end face 2 of bar 1 is non-planar as a result of a previous slicing operation wherein, for example, the cutting tool, e.g., an internal hole saw, migrated or deviated from its intended path due to cutting forces, tool wear, or the like. According to the invention, rather than slicing a disc-shaped workpiece from the bar 1 at this stage as is conventional, the non-planar end face 2 of bar 1 is machined, such as by a grinding process designated by the series of triangles 3, to produce a precisely planar surface 2' as shown at stage (b). At stage (c), the bar 1 is sliced by an internal hole saw to produce a workpiece 4 having the planar surface 2' and an opposed surface 5. Surface 5 is non-planar as a result of cutting tool deviations during the slicing operation as described. The bar 1 now has a new end face 6(2) which is non-planar as a result of the same cutting tool deviations and in essence is in the stage (a) condition as represented by arrow 7. Since the disc-shaped workpiece has one precisely planar surface, i.e. surface 2', it can be clamped on a plate 8 with surface 2' engaging plate 8 and acting as a reference surface without the workpiece deforming and without any stresses being set up in the workpiece 4. At stage (d), the non-planar surface 5 is subjected to a planing operation, such as a grinding operation designated 9, to provide a precisely planar surface 5' parallel to surface 2' to thereby produce a wafer 20 having opposed planar and parallel surfaces. When wafer 20 is released from clamping plate 8, it no longer deforms as in the case of wafer 14 of FIG. 1. The processes can then be repeated to form another wafer as indicated by arrow 7. It will be understood that the bar 1 may be positioned with its longitudinal axis in a vertical orientation as shown or in any other orientation as desired. Moreover, the slicing and grinding operation may be carried out with respect to a plane perpendicular to the axis of bar 1 or in a plan at least slightly oblique thereto.

The integration of the slicing and grinding operations in accordance with the method of the invention can be performed by apparatus which essentially comprise an integration of conventional slicing apparatus and conventional grinding apparatus. Thus, apparatus in accordance with the invention in its simplest form comprises a combination of an internal hole saw and a grinding machine. The apparatus preferably is such that both the slicing and grinding operations are performed by a single machine.

Figure 3A:
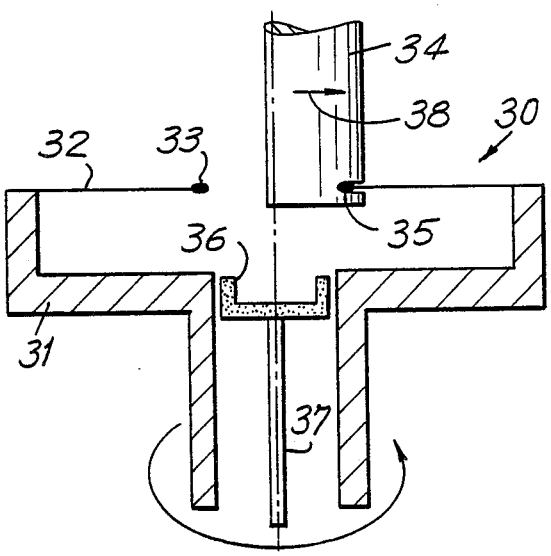
FIGS. 3(*a*) and 3(*b*) are schematic elevation views illustrating a first embodiment of apparatus in accordance with the present invention for performing a method in accordance with the invention.
Figure 3B:
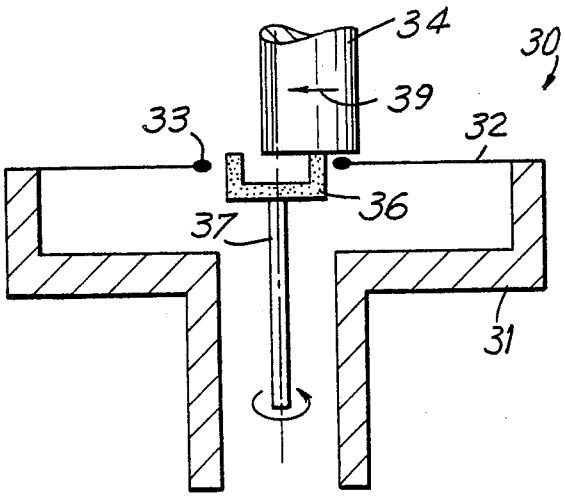

One embodiment of apparatus in accordance with the invention, generally designated 30, is illustrated in FIG. 3 in schematic form. Referring to FIG. 3(*a*), a sawhead 31 mounted for rotation in a machine frame (not shown) carries an internal hole saw blade 32 having an internal cutting edge 33. A cup-shaped grinding wheel or disc 36 is mounted on a shaft 37 within a tubular portion of saw head 31 for rotation about an axis that passes through the center of the opening defined by the cutting edge 33. Shaft 37 is mounted in a frame (not shown) for rotation as well as for axial movement by axial feed means (not shown). By radial feed means (not shown) advancing the bar 34 in a transverse direction, designated by arrow 38, a disc-shaped workpiece 35 is separated from the bar 34 (as at stage (c) in FIG. 2). Referring to FIG. 3(*b*), the non-planar end face 2 (corresponding to end face 2 at stage (a) in FIG. 2) of bar 34 is subsequently planed (stage (b) of FIG. 2) by axially advancing the rotating grinding wheel 36 above the cutting edge 33 of saw blade 32 until the grinding wheel 36 engages surface 2 and then transversely advancing bar 34 as designated by arrow 39. As noted above, it is immaterial whether the axes of the bar, saw and grinding wheel are vertical or are in any other orientation, such as horizontal. It is also nonessential for the grinding wheel and saw head to be mounted and driven separately or together.

Figure 4:
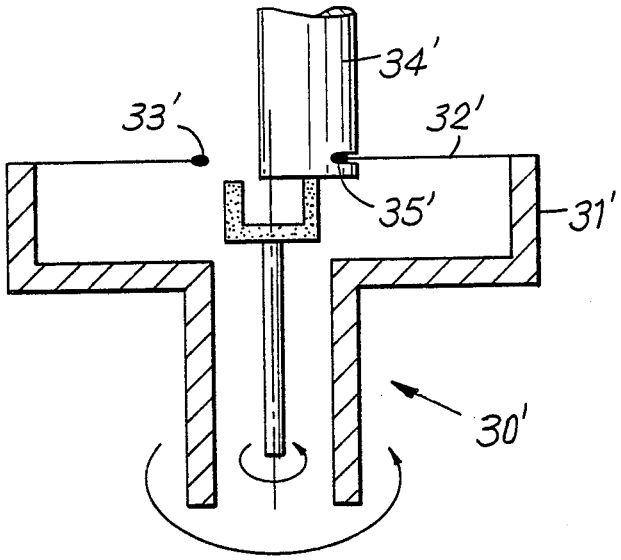
FIG. 4 is a schematic elevation view illustrating a second embodiment of apparatus in accordance with the invention for performing a method in accordance with the invention.

The process can be improved by performing the slicing and grinding steps at the same time, i.e., in a method wherein the end face of the bar is ground to a planar condition at the same time that the workpiece is being sliced from the bar. Referring to FIG. 4, apparatus designated 30' is illustrated for performing such method. Apparatus 30' is essentially similar to apparatus 30 of FIG. 3. However, in order to permit the grinding operation to be performed during the slicing operation, the working edge of the grinding disc is set back behind the saw blade 32' by a distance substantially equal to the thickness of the disc-shaped workpiece 35' being produced. Since the workpiece 35' is not yet separated from bar 34', at least in the region at which it is being ground, all of the conditions for distortion-free planing of the reference surface in accordance with the method of the invention are satisfied.

Where it is not possible or desired to perform the grinding step within the opening defined by the cutting edge of the internal hole saw blade, it is necessary to provide the apparatus with slicing and grinding stations which are spaced from each other and which operate on the bar at different times. Such apparatus are shown in FIGS. 5 and 6.

Figure 5:
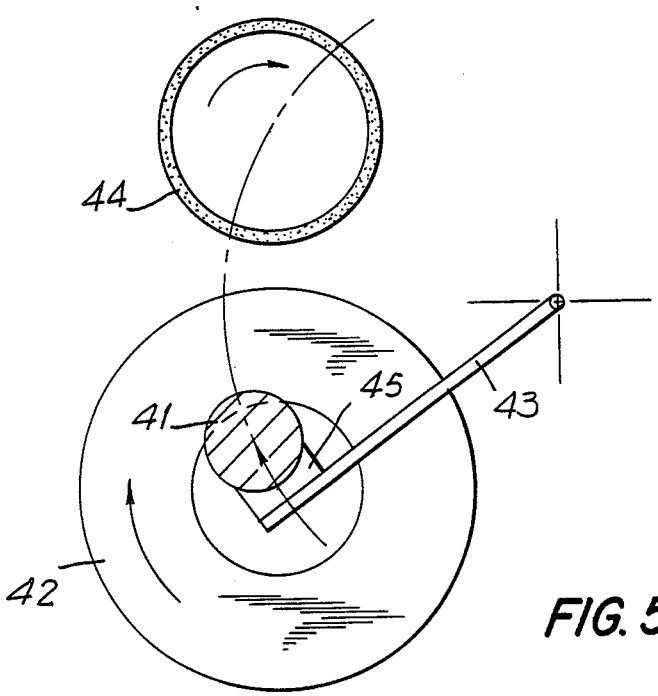
FIG. 5 is a schematic plan view illustrating a third embodiment of apparatus in accordance with the invention for performing a method in accordance with the invention.

Referring to FIG. 5, the bar 41 is clamped in a holder 45 which is connected to one end of an arm 43 which is pivoted at its other end to the machine frame. A workpiece is sliced by the blade 42 of the internal hole saw by pivotally advancing the arm 43 by radial feed means (not shown). Upon completion of the slicing operation, the arm 43 is further pivoted to transfer the bar from the slicing station to a grinding station at which a grinding disc 44 is situated whereupon the newly produced non-planar end face of bar 41 is ground to a planar condition in accordance of the invention.

Figure 6A:
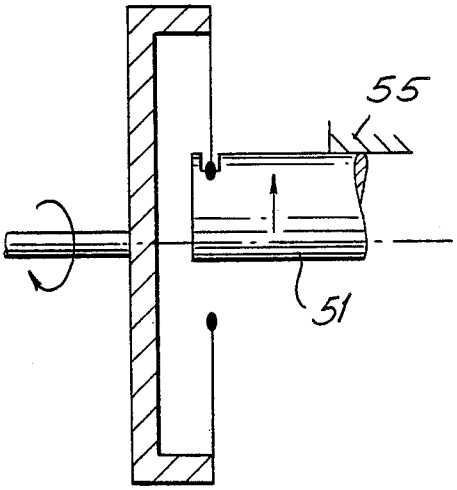
FIGS. 6(*a*) and 6(*b*) are schematic elevation views illustrating a fourth embodiment of apparatus in accordance with the invention for performing a method in accordance with the invention.
Figure 6B:
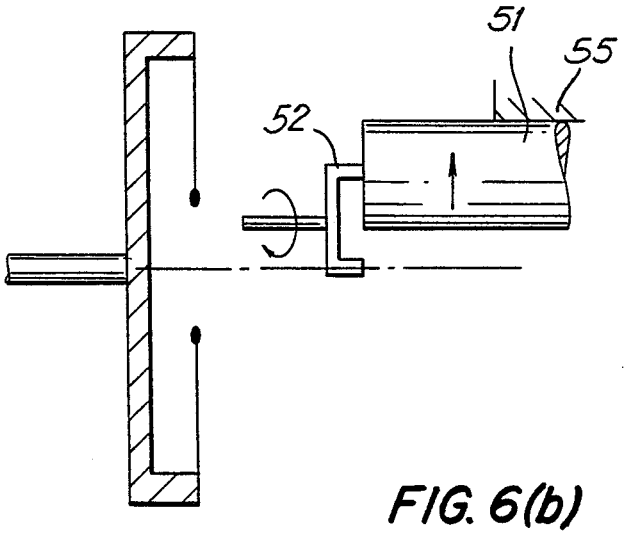

Referring now to FIG. 6, the bar 51 is mounted in a holder 55 mounted to the machine frame comprising both axial and radial feed means for movement in directions both parallel and transverse to the bar axis. Upon completion of the slicing operation using an internal hole saw 53 as seen in FIG. 6(*a*), the bar 51 is carried from the slicing station by holder 55 in a direction parallel to its axis to a grinding station which is sufficiently spaced from the slicing station that the grinding disc 52 of a grinding machine can be introduced to perform the grinding step.

Figure 7:
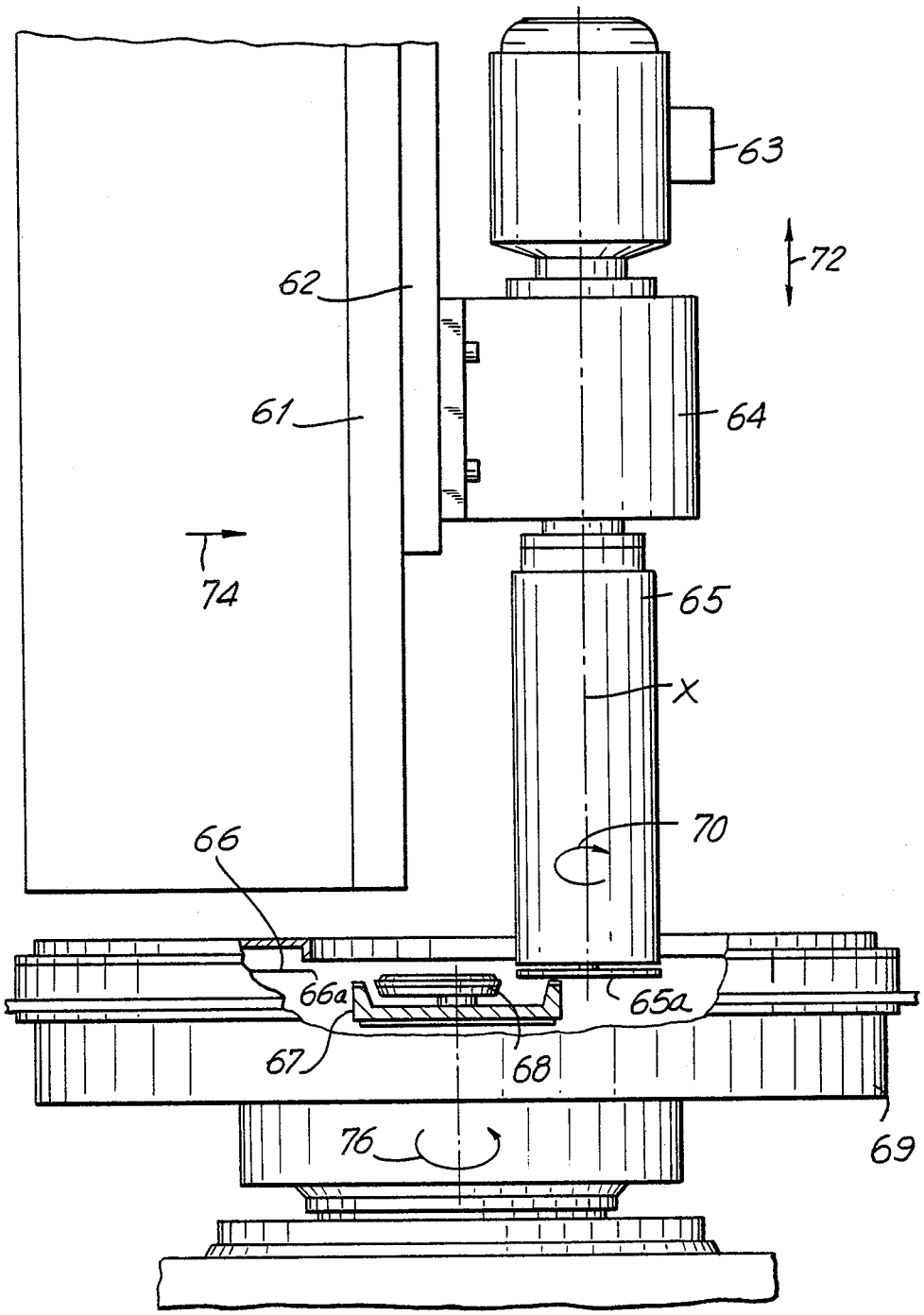
FIG. 7 is a schematic elevation view illustrating another embodiment of apparatus in accordance with the invention for performing a method according to the invention.

Referring to FIGS. 7 and 8, another embodiment of apparatus in accordance with the invention is illustrated which is especially suited for producing disc-shaped workpieces or wafers of extremely hard materials, such as sapphire, ruby and YAG.

The apparatus illustrated in FIGS. 7 and 8 and the method performed thereby differ from the embodiments described above in that the bar of material is fixed to means for rotating the same with respect to its longitudinal axis so that the bar is rotating during the grinding and slicing processes.

Still referring to FIGS. 7 and 8, the bar 65 is mounted on the spindle of a rotation device 64 which is driven by a motor 63 so that in operation of the apparatus, the bar 65 can be rotated with respect to its longitudinal axis X, preferably at a rate in the range of between about 50 to 500 r.p.m.

The rotation device 64 is itself mounted on a vertically adjustable slide 62 comprising axial feed means for indexing the bar 65 in a vertical direction, designated by arrow 72, after a wafer has been sliced therefrom as described in greater detail below. The slide 62 is in turn mounted on an arm 61 comprising radial feed means which is coupled to the machine frame (not shown) for movement in the horizontal or radial direction, designated by arrow 74.

An internal hole saw blade 66 is carried by a sawhead 69 which is mounted for rotation, designated by arrow 76, on the machine frame, preferably at a rate in the range of between about 500 to 1500 r.p.m. A cup-shaped grinding wheel 67 is mounted within the sawhead 69 on a shaft mounted for axial and, preferably, vertical movement on axial feed means (not shown) so the annular grinding surface 67*a* is substantially concentric with the cutting edge 66*a* of saw blade 66 (FIG. 8).

A wafer support 68 for holding a single wafer after the slicing operation has been completed is also positioned within the sawhead 69. The wafer support 68 is mounted for translation so as to be positioned beneath the wafer as the slicing process is completed.

In operation, referring to FIG. 8A, the apparatus is shown at a point immediately prior to the bar 65 engaging the saw blade 66. As seen in FIG. 8A, the axis X of bar 65 is situated over the grinding surface 67*a* of grinding wheel 67. The bar 65 is rotated (arrow 70) whereby the surface 65*a* (FIG. 7) is planed. The grinding wheel may be rotated at the same time. While rotating, the bar is moved horizontally to the right (arrow 74) whereupon it engages the saw blade 66 and continues to advance in this manner until reaching a position slightly to the right of that shown in FIG. 8B whereupon the slicing of the wafer is completed. The wafer support 68 meanwhile moves beneath the sliced wafer to support it as the slicing operation is completed.

In an alternative method of operation, the grinding surface 67*a* remains out of contact with the surface 65*a* during the slicing operation, i.e. as the bar moves horizontally to the right from the position shown in FIG. 8A to that shown in FIG. 8B. After slicing has been completed, the grinding wheel is moved upwardly by axial feed means so that grinding surface 67*a* engages the newly formed bottom surface of bar 65. The rotating bar 65 is then moved horizontally to the left so that the surface of bar 65 is planed by grinding surface 67*a*. Upon reaching the position shown in FIG. 8A, the grinding wheel is lowered and bar 65 is indexed downwardly a distance equal to the desired thickness of the wafer. The bar is then moved again to the right and another wafer is sliced.

The method and apparatus described above are advantageous for a number of reasons. A grinding wheel of significantly smaller diameter can be used due to the rotary face grinding technique employed. As the bar need only be sliced to its center, the slicing time is substantially halved. The smaller contact zones of the rotating slicing create smaller slicing forces and therefore easier lubrication. The grinding of the surface of the bar is completed in a shorter time compared to the time required in a process where the grinding surface is in contact with the bar surface for most of the planing/-slicing cycle. Since the contact zone is smaller and the resulting grinding force is constant, a better flatness of the bar surface is achieved. Since the slicing motion is towards the center of the rotating bar, no lateral support of the bar is necessary. As the saw blade finishes in the center of the bar, edge breakage problems are eliminated.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. Apparatus for manufacturing thin wafers of hard, non-metallic material, such as monocrystalline or polycrystalline material for use as semiconductor substrates, from a bar of such material, said wafers having at least one precisely planar surface, said bar having an end face and a substantially central longitudinal axis, comprising:

an internal hole saw including a saw head and a cutting blade mounted for rotation around a slicing axis of rotation, said saw blade having a substantially circular internal cutting edge;

a cup-shaped grinding wheel having an annular grinding region, said grinding wheel being mounted in said saw head for rotation, and means for rotating said grind wheel around a grinding axis of rotation;

means for rotating said bar around said substantially central longitudinal axis thereof;

axial feed means for advancing at least one of said grinding wheel and said bar towards each other in an axial direction substantially parallel to one of said grinding axis and said bar axis with both said grinding wheel and bar rotating until said grinding region of said rotating grinding wheel engages and planes said end face of said bar during rotation thereof to a substantially precisely planar condition; and radial feed means for advancing said bar, after said end face thereof is planed, in a radial direction with respect to said cutting edge of said saw blade and into engagement with said cutting edge until a wafer including said planed end face is sliced from said bar.

2. The apparatus of claim 1 wherein said axial feed means further include means for retracting at least one of said grinding wheel and bar away from the other to disengage said grinding region of said grinding wheel from said end face of said bar during said slicing operation.

3. The apparatus of claim 1 further including means for moving one of said rotating bar and said rotating grinding wheel, prior to said bar engaging said saw blade cutting edge, from a first position wherein said annular grinding region of said grinding wheel initially engages a peripheral region of said end face of said rotating bar to a second position wherein said grinding region engages a region of said rotating bar end face aligned with said central longitudinal axis thereof.

4. The apparatus of claim 1 wherein said radial feed means further comprise means for moving said bar subsequent to said bar end face being planed from a first position where it initially engages said internal cutting edge of said cutting blade to a second position wherein said internal cutting edge has sliced through the said bar.

5. The apparatus of claim 4 wherein said bar is nonrotating during movement of said bar between said first and second positions.

6. The apparatus of claim 1 wherein said radial feed means further comprise means for moving said bar subsequent to said bar end face being planed from a first position where it initially engages said internal cutting edge of said cutting blade to a second position wherein said internal cutting edge intersects said central longitudinal axis of said rotating bar.

7. The apparatus of claim 6 wherein said means for rotating said bar rotates said bar during movement thereof between said first and second positions whereby said rotating bar is completely sliced by said cutting edge of said cutting blade.

* * * * *